US009181918B2

(12) United States Patent
Abe

(10) Patent No.: US 9,181,918 B2
(45) Date of Patent: Nov. 10, 2015

(54) ASSEMBLY OF SPARK PLUG AND ENGINE MAIN BODY

(71) Applicant: DENSO CORPORATION, Kariya, Aichi-pref. (JP)

(72) Inventor: Nobuo Abe, Yokkaichi (JP)

(73) Assignee: DENSO CORPORATION, Kariya (JP)

( * ) Notice: Subject to any disclaimer, the term of this patent is extended or adjusted under 35 U.S.C. 154(b) by 324 days.

(21) Appl. No.: 13/655,587

(22) Filed: Oct. 19, 2012

(65) Prior Publication Data

US 2013/0098324 A1 Apr. 25, 2013

(30) Foreign Application Priority Data

Oct. 20, 2011 (JP) ..... 2011-230428

(51) Int. Cl.

| | |
|---|---|
| ***F02P 13/00*** | (2006.01) |
| ***H01T 13/08*** | (2006.01) |
| ***H01T 21/02*** | (2006.01) |
| ***H01T 13/20*** | (2006.01) |
| ***H01T 13/32*** | (2006.01) |
| ***H01T 13/39*** | (2006.01) |

(Continued)

(52) U.S. Cl.

CPC ..... *F02P 13/00* (2013.01); *F02F 1/242* (2013.01); *F02F 11/002* (2013.01); *H01T 13/08* (2013.01); *H01T 13/20* (2013.01); *H01T 13/32* (2013.01); *H01T 13/39* (2013.01); *H01T 21/02* (2013.01)

(58) Field of Classification Search

CPC ..... H01T 13/08; H01T 13/32; H01T 13/20; H01T 13/39; H01T 21/02

USPC ..... 123/169 R

See application file for complete search history.

(56) References Cited

U.S. PATENT DOCUMENTS 6,489,709 B1 * 12/2002 Teramura et al. ..... 313/140
7,109,645 B2 * 9/2006 Suzuki et al. ..... 313/118

(Continued)

FOREIGN PATENT DOCUMENTS

JP 50-71635 U 6/1975
JP 2000-304134 11/2000

(Continued)

OTHER PUBLICATIONS

Office Action (7 pages) dated Oct. 21, 2014 issued in corresponding Japanese Application No. 2011-230428 and English translation (8 pages).

(Continued)

*Primary Examiner* — Hai Huynh
*Assistant Examiner* — Raza Najmuddin
(74) *Attorney, Agent, or Firm* — Nixon & Vanderhye P.C.

(57) ABSTRACT

An assembly includes an engine main body, a spark plug and a gasket. The spark plug is mounted to the engine main body by tightening a male-threaded portion of the spark plug into a female-threaded portion of the engine main body with the gasket elastically deformed between a seat surface of the engine main body and a seating surface of the spark plug. The gasket is made of a metallic material whose yield stress or 0.2% proof stress is not lower than 200 N/mm$^2$. The gasket has first and second contact surfaces respectively in contact with the seating surface of the spark plug and the seat surface of the engine main body. The first and second contact surfaces of the gasket are each formed as a part of a curved surface that has a convex shape, and are offset from each other in a radial direction of the spark plug.

6 Claims, 10 Drawing Sheets

(51) Int. Cl.
*F02F 1/24* (2006.01)
*F02F 11/00* (2006.01)

(56) References Cited

U.S. PATENT DOCUMENTS

| | | | | |
|---|---|---|---|---|
| 7,914,353 | B2 * | 3/2011 | Kobayashi et al. | 445/7 |
| 7,944,135 | B2 * | 5/2011 | Walker, Jr. | 313/145 |
| 8,067,882 | B2 * | 11/2011 | Fukuzawa et al. | 313/135 |
| 8,766,521 | B2 * | 7/2014 | Yoshizaki et al. | 313/141 |
| 2002/0153669 | A1 | 10/2002 | Caplain et al. | |
| 2004/0066124 | A1 * | 4/2004 | Kanao et al. | 313/135 |
| 2005/0127808 | A1 | 6/2005 | Suzuki et al. | |

FOREIGN PATENT DOCUMENTS

| | | |
|---|---|---|
| JP | 2001-187966 | 7/2001 |
| JP | 2003-090436 | 3/2003 |
| JP | 2004-134120 | 4/2004 |
| JP | 2004-528516 | 9/2004 |
| JP | 2005-197206 | 7/2005 |
| JP | 2012-031834 | 2/2012 |
| JP | 2012-031835 | 2/2012 |

OTHER PUBLICATIONS

Author Unknown, JIS Handbook Steel, Japanese Standards Association, Apr. 12, 1984, pp. 952, 953, 1414 and 1415 (2 pages).

Office Action (8 pages) dated Sep. 17, 2014 issued in corresponding Chinese Application No. 201210399361.9 and English translation (8 pages).

Japanese Office Action issued in JP Application No. 2011-230428 dated May 12, 2015 (w/ partial translation).

* cited by examiner

ASSEMBLY OF SPARK PLUG AND ENGINE MAIN BODY

CROSS-REFERENCE TO RELATED APPLICATION

This application is based on and claims priority from Japanese Patent Application No. 2011-230428, filed on Oct. 20, 2011, the content of which is hereby incorporated by reference in its entirety into this application.

BACKGROUND

1 Technical Field

The present invention relates to an assembly of a spark plug and an engine main body, which includes a gasket to hermetically seal between the spark plug and the engine main body.

2 Description of Related Art

A spark plug is generally mounted to a main body of an internal combustion engine of a motor vehicle or a cogeneration system, so as to ignite the air-fuel mixture in a combustion chamber of the engine by generating sparks in a spark gap of the spark plug.

More specifically, the spark plug is generally mounted to a cylinder head (i.e., a part of the main body) of the engine by threadedly engaging a male-threaded portion formed on an outer surface of a metal shell of the spark plug with a female-threaded portion formed in an inner surface of a spark plug-mounting bore of the cylinder head.

Moreover, there is disclosed, for example in Japanese Patent Application Publication No. 2001-187966, a technique for reliably sealing between the metal shell of the spark plug and the cylinder head. According to the technique, a substantially annular gasket is interposed between a seat surface of the cylinder head and a seating surface of the metal shell of the spark plug. The seat surface of the cylinder head is formed around an open end of the spark plug-mounting bore; the open end is on the opposite side to the combustion chamber of the engine. The seating surface of the metal shell is formed on the proximal side (i.e., the opposite side to the combustion chamber) of the male-threaded portion of the metal shell so as to face the seat surface of the cylinder head. In mounting the spark plug to the cylinder head, the male-threaded portion of the metal shell of the spark plug is tightened into the female-threaded portion of the cylinder head, elastically deforming the gasket interposed between the seat surface of the cylinder head and the seating surface of the metal shell. Consequently, with an elastic force of the gasket, which is created by the elastic deformation of the gasket, it is possible to maintain the tightening axial force of the male-threaded portion of the metal shell of the spark plug, thereby forming a hermetic seal (or fluid-tight seal) between the seat surface of the cylinder head and the seating surface of the metal shell.

However, in recent years, lean burn and high output have been pursued for engines, resulting in increases in the combustion temperatures as well as in vibration of the engines. Consequently, when the above technique is used, an excessive force may come to be applied to the gasket, causing the gasket to be plastically deformed and thereby decreasing the thickness of the gasket in the axial direction of the spark plug. That is, "permanent set" of the gasket may occur, thereby lowering the elastic force of the gasket. As a result, it may become difficult to secure a high sealing performance between the metal shell of the spark plug and the cylinder head of the engine.

Further, with occurrence of permanent set of the gasket, the tightening axial force of the male-threaded portion of the metal shell of the spark plug may be lowered, thereby loosening the engagement between the male-threaded portion of the metal shell and the female-threaded portion of the cylinder head.

To prevent permanent set of the gasket from occurring, one may consider increasing the yield stress of the gasket.

On the other hand, the main purpose of employing the gasket is to realize, with the elastic deformation of the gasket during the tightening of the male-threaded portion of the metal shell into the female-threaded portion of the cylinder head, intimate contact between the seat surface of the cylinder head and the seating surface of the metal shell, thereby securing a high fluid-tightness therebetween.

However, if the yield stress of the gasket is increased for preventing occurrence of permanent set of the gasket, it may become difficult for the gasket to be elastically deformed during the tightening of the male-threaded portion of the metal shell into the female-threaded portion of the cylinder head, thereby making it difficult to realize intimate contact between the seat surface of the cylinder head and the seating surface of the metal shell. Consequently, it may become difficult to secure a high fluid-tightness between the seat surface of the cylinder head and the seating surface of the metal shell.

SUMMARY

According to an exemplary embodiment, an assembly is provided which includes a main body of an engine, a spark plug and a substantially annular gasket. The main body of the engine has a spark plug-mounting bore formed therein. The main body also has a female-threaded portion that is formed in the inner surface of the spark plug-mounting bore and a seat surface that is formed around an open end of the spark plug-mounting bore. The spark plug has a longitudinal axis and a male-threaded portion that is formed on an outer surface of the spark plug so as to threadedly engage with the female-threaded portion of the main body of the engine. The spark plug also has a seating surface that is formed on one side of the male-threaded portion so as to face the seat surface of the main body of the engine. The gasket is interposed between the seat surface of the main body of the engine and the seating surface of the spark plug so as to hermetically seal therebetween. The spark plug is mounted to the main body of the engine by tightening the male-threaded portion of the spark plug into the female-threaded portion of the main body with the gasket elastically deformed between the seat surface of the main body of the engine and the seating surface of the spark plug. The gasket is made of a metallic material whose yield stress or 0.2% proof stress is higher than or equal to 200 $N/mm^2$. The gasket has a first contact surface that is in contact with the seating surface of the spark plug and a second contact surface that is in contact with the seat surface of the main body of the engine. The first and second contact surfaces of the gasket are each formed as a part of a curved surface that has a convex shape on a cross section of the gasket; the cross section is taken so as to lie in the same plane as the longitudinal axis of the spark plug. The first and second contact surfaces of the gasket are offset from each other in a radial direction of the spark plug.

With the above configuration, during the mounting of the spark plug to the main body of the engine, the substantially annular gasket can be elastically deformed, by the tightening axial force of the male-threaded portion of the spark plug, over the entire circumference of the gasket in such a manner that the contact region between the seating surface of the spark plug and the gasket is shifted radially inward, while the contact region between the seat surface of the main body of the engine and the gasket is shifted radially outward. That is, the gasket can be deformed not locally, but over its entirety. Therefore, even if a large force is applied to the gasket, it is difficult for the deformation of the gasket to reach the plastic region (in other words, it is easy for the deformation of the gasket to remain in the elastic region). Consequently, during operation of the engine, even if a large external force is applied to the gasket due to vibration of the engine, it is still possible to prevent the gasket from being plastically deformed, thereby preventing the sealing performance of the gasket from being lowered.

Moreover, since the gasket can be deformed over its entirety, it is unnecessary for the metallic material, of which the gasket is made, to have an extremely high yield stress or 0.2% proof stress for the purpose of preventing plastic deformation of the gasket from occurring under a large force. In other words, it is possible to make the gasket with a metallic material that has a moderate yield stress or 0.2% proof stress. Consequently, during the mounting of the spark plug to the main body of the engine, it is easy for the gasket to be elastically deformed by the tightening axial force of the male-threaded portion of the spark plug, thereby reliably bringing the first and second contact surfaces of the gasket respectively into intimate contact with the seating surface of the spark plug and the seat surface of the main body of the engine. As a result, it is possible for the gasket to reliably seal between the seating surface of the spark plug and the seat surface of the main body of the engine.

Furthermore, since the first and second contact surfaces of the gasket are each formed as a part of a curved surface that has a convex shape on the cross section of the gasket, it is possible to realize approximately circular-line contacts between the first contact surface of the gasket and the seating surface of the spark plug and between the second contact surface of the gasket and the seat surface of the main body of the engine, thereby more reliably securing a high sealing performance of the gasket.

Furthermore, since the yield stress or 0.2% proof stress of the metallic material, of which the gasket is made, is higher than or equal to 200 $N/mm^2$, it is possible to more reliably prevent plastic deformation of the gasket from occurring under a large force. In addition, if the yield stress or 0.2% proof stress of the metallic material was lower than 200 $N/mm^2$, it would be easy for the gasket to be plastically deformed under a large force, making it difficult to secure a high sealing performance of the gasket.

It is preferable that the metallic material, of which the gasket is made, is stainless steel.

It is also preferable that the cross section of the gasket, which is taken so as to lie in the same plane as the longitudinal axis of the spark plug, has a substantially S-shape or substantially inverted S-shape.

It is also preferable that the amount of radial offset between the first and second contact surfaces of the gasket is greater than or equal to 0.6 mm.

It is also preferable that the mean value of a radial width L1 of the first contact surface and a radial width L2 of the second contact surface of the gasket is in the range of 0.2 to 0.7 mm.

BRIEF DESCRIPTION OF THE DRAWINGS

The present invention will be understood more fully from the detailed description given hereinafter and from the accompanying drawings of exemplary embodiments, which, however, should not be taken to limit the invention to the specific embodiments but are for the purpose of explanation and understanding only.

In the accompanying drawings.

DESCRIPTION OF EMBODIMENTS

Figure 1:
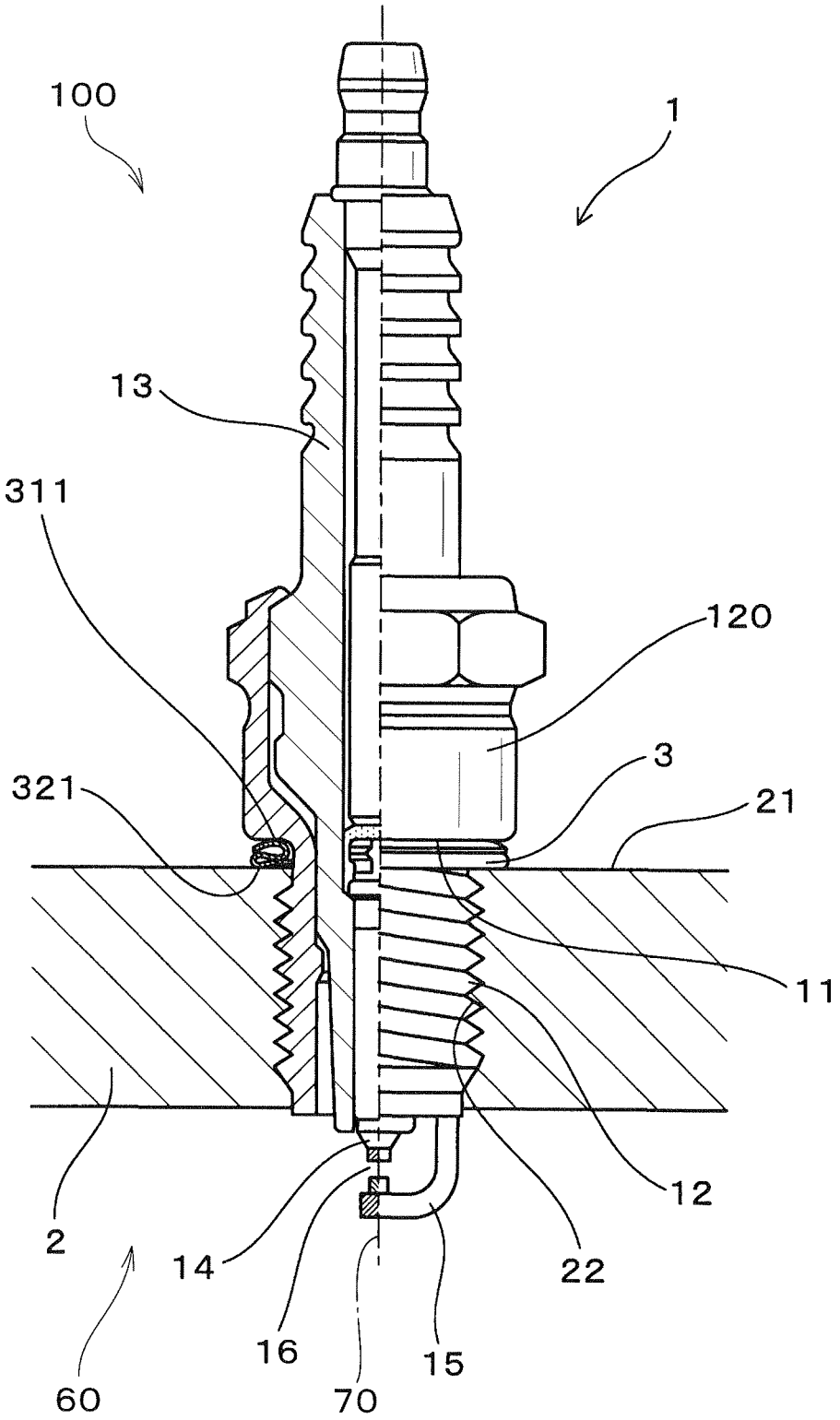
FIG. 1 is a partially cross-sectional view illustrating the overall configuration of an assembly of a spark plug and a cylinder head according to a first embodiment.

Exemplary embodiments will be described hereinafter with reference to FIGS. 1-18. It should be noted that for the sake of clarity and understanding, identical components having identical functions in different embodiments have been marked, where possible, with the same reference numerals in each of the figures and that for the sake of avoiding redundancy, descriptions of the identical components will not be repeated.

First Embodiment

FIG. 1 shows the overall configuration of an assembly 100 according to a first embodiment. The assembly 100 is obtained by mounting a spark plug 1 to a cylinder head 2 of an internal combustion engine. The spark plug 1 is configured to ignite the air-fuel mixture in a combustion chamber 60 of the engine. In addition, the engine may be used in, for example, a motor vehicle, a cogeneration system or a gas-delivering pump.

As shown in FIG. 1, the spark plug 1 has a male-threaded portion 12 formed on an outer surface thereof. The cylinder head 2 has a spark plug-mounting bore that is formed so as to penetrate the cylinder head 2 in an axial direction of the spark plug 1. The spark plug-mounting bore has a first open end that faces the combustion chamber 60 and a second open end that is on the opposite side to the combustion chamber 60. Further, in the inner surface of the spark plug-mounting bore (i.e., an inner surface of the cylinder head 2 which defines the spark plug-mounting bore), there is formed a female-threaded portion 22 for threadedly engaging (or mating) with the male-threaded portion 12 of the spark plug 1.

The cylinder head 2 has a seat surface 21 that is formed around the second open end of the spark plug-mounting bore of the cylinder head 2. The spark plug 1 has a seating surface 11 that is formed on a proximal side (i.e., the opposite side to the combustion chamber 60) of the male-threaded portion 12 so as to face the seat surface 21 of the cylinder head 2 in the axial direction of the spark plug 1.

Further, a gasket 3 is interposed between the seat surface 21 of the cylinder head 2 and the seating surface 11 of the spark plug 1, so as to hermetically seal between the two surfaces 21 and 11. Consequently, the seating surface 11 of the spark plug 1 seats on the seat surface 21 of the cylinder head 2 via the gasket 3.

The gasket 3 is made of a metallic material whose yield stress or 0.2% proof stress is higher than or equal to 200 $N/mm^2$. Here, 0.2% proof stress denotes, when the metallic material has no clearly-defined yield point, the stress at which a permanent strain of 0.2% is produced.

Figure 2:
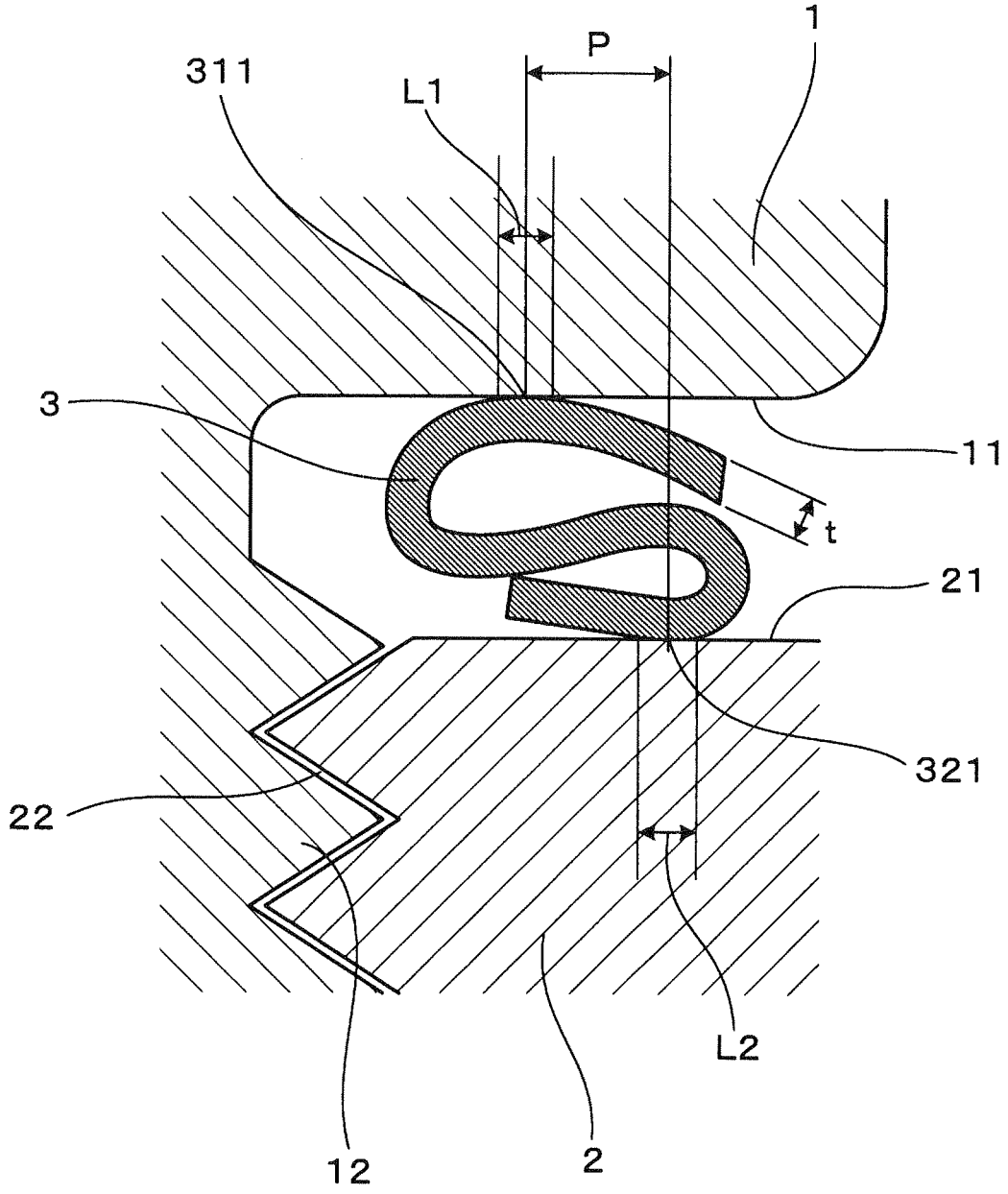
FIG. 2 is an enlarged cross-sectional view of part of the assembly according to the first embodiment.

Moreover, as shown in FIG. 2, the gasket 3 has a first contact surface 311 that is in contact with the seating surface 11 of the spark plug 1 and a second contact surface 321 that is in contact with the seat surface 21 of the cylinder head 2. The first and second contact surfaces 311 and 321 are each formed as a part of a curved surface that has a convex shape on a cross section of the gasket 3; the cross section is taken so as to lie in the same plane as a longitudinal axis 70 (see FIG. 1) of the spark plug 1. Further, the first and second contact surfaces 311 and 321 are offset from each other in a radial direction of the spark plug 1 (i.e., in the horizontal direction in FIG. 2).

Next, the detailed configuration of the assembly 100 according to the present embodiment will be described.

Figure 4:
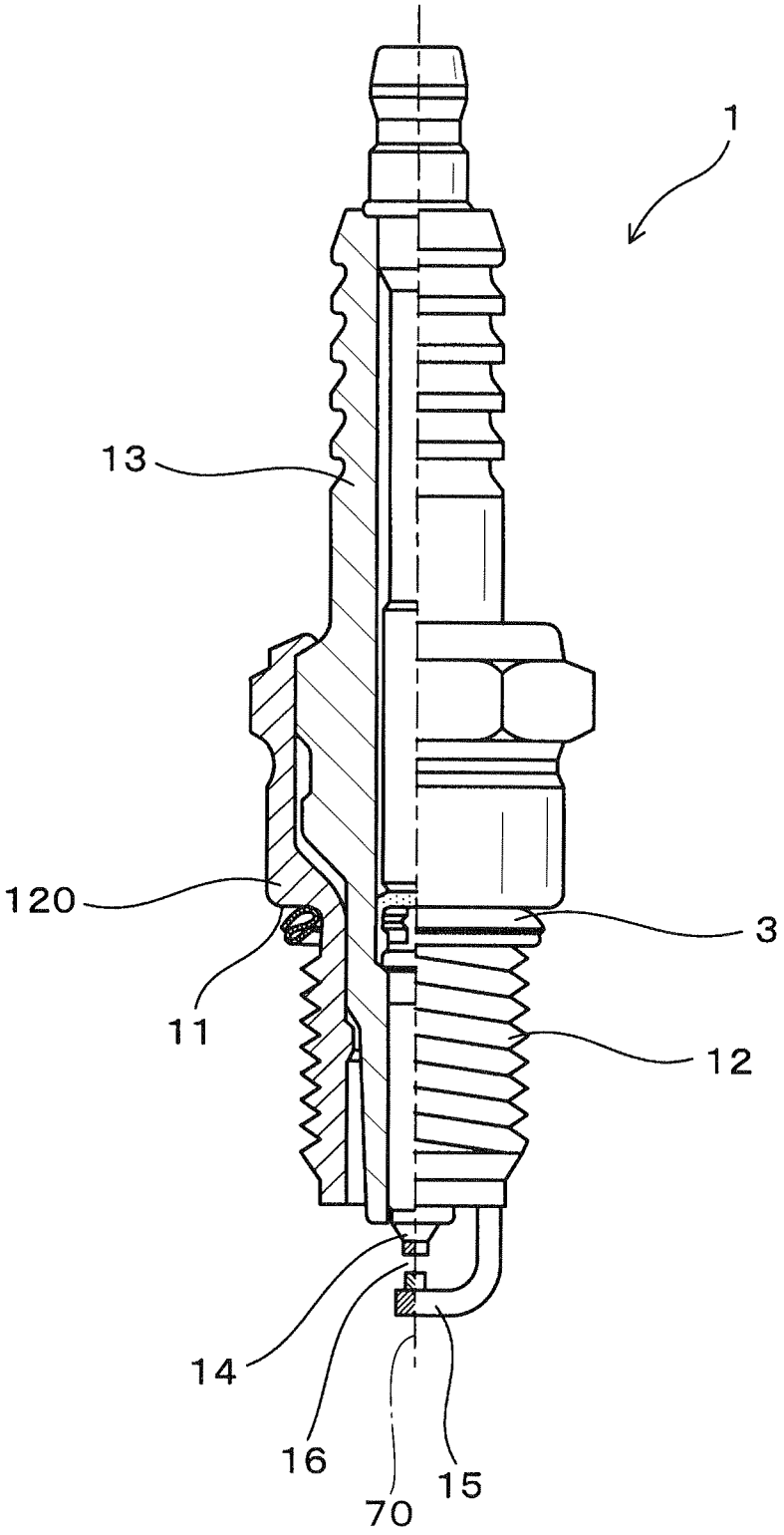
FIG. 4 is a partially cross-sectional view of the spark plug.

As shown in FIGS. 1 and 4, the spark plug 1 includes a metal shell (or metal housing) 120 that is made of, for example, carbon steel and has a substantially hollow cylindrical shape. The male-threaded portion 12 of the spark plug 1 is formed on the outer surface of the metal shell 120.

In the metal shell 120, there is retained an insulator 13 that is made of a ceramic (e.g., alumina) and has a substantially hollow cylindrical shape. Further, in the insulator 13, there is retained a substantially cylindrical center electrode 14.

A ground electrode 15, which is substantially L-shaped, has one end fixed to a distal end (i.e., the lower end in FIGS. 1 and 4) of the metal shell 120 and the other end facing a distal end of the center electrode 14 in the axial direction of the spark plug 1 through a spark gap 16 formed therebetween.

The metal shell 120 has, on the proximal side of the male-threaded portion 12, a large-diameter portion that has a larger diameter than the male-threaded portion 12. The seating surface 11 of the spark plug 1 is formed at the male-threaded portion 12-side end of the large-diameter portion so as to have a substantially annular shape.

Figure 3:
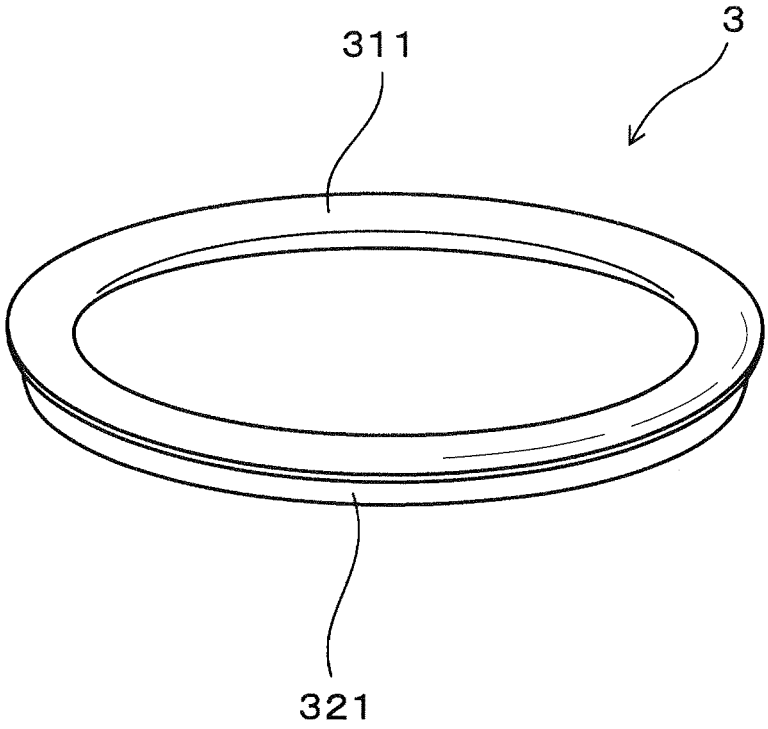
FIG. 3 is a perspective view of a gasket used in the assembly to hermetically seal between the spark plug and the cylinder head.

As shown in FIG. 3, the gasket 3 has a substantially annular shape. The gasket 3 may be formed by, for example, punching or bending a metal plate using a press machine.

In the present embodiment, the gasket 3 is made of stainless steel (SUS according to JIS). However, it should be noted that the gasket 3 may also be made of other metallic materials having a yield stress or 0.2% proof stress higher than or equal to 200 $N/mm^2$, such as rolled steel plate.

Moreover, as shown in FIG. 2, a cross section of the gasket 3, which is taken so as to lie in the same plane as the longitudinal axis 70 of the spark plug 1, has a substantially S-shape or substantially inverted S-shape.

More specifically, the substantially S-shaped or substantially inverted S-shaped cross section of the gasket 3 has two turn portions that are respectively oriented toward opposite directions. The cross section of the gasket 3 also has first to third portions that overlap each other in the axial direction of the spark plug 1. The first portion extends between one of the two turn portions (i.e., the left-upper turn portion in FIG. 2) and one end (i.e., the right-upper end in FIG. 2) of the cross section and has the first contact surface 311 provided therein. The second portion extends between the two turn portions. The third portion extends between the other turn portion (i.e., the right-lower turn portion in FIG. 2) and the other end (i.e., the left-lower end in FIG. 2) of the cross section and has the second contact surface 321 provided therein.

In addition, in the present embodiment, the one end of the cross section is kept from making contact with any other portion of the cross section, whereas the other end of the cross section is kept in contact with the second portion of the cross section.

It should be noted that: the one end of the cross section may also be kept in contact with the other turn portion or the second portion of the cross section; and the other end of the cross section may also be kept from making contact with any other portion of the cross section.

In the present embodiment, the amount of radial offset P between the first and second contact surfaces 311 and 321 of the gasket 3 is set to be greater than or equal to 0.6 mm. Here, the amount of radial offset P denotes the distance between the radial centers of the first and second contact surfaces 311 and 321; the radial center of the first contact surface 311 is equidistant from the radially inner and outer peripheries of the first contact surface 311; the radial center of the second contact surface 321 is equidistant from the radially inner and outer peripheries of the second contact surface 321.

In the present embodiment, the mean value L0 of the radial width L1 of the first contact surface 311 and the radial width L2 of the second contact surface 321 is set to be in the range of 0.2 to 0.7 mm (i.e., 0.2 mm≤(L1+L2)/2≤0.7 mm). Moreover, each of the radial widths L1 and L2 of the first and second contact surfaces 311 and 321 is set to be greater than or equal to 0.1 mm (i.e., L1≥0.1 mm and L2≥0.1 mm).

Figure 5:
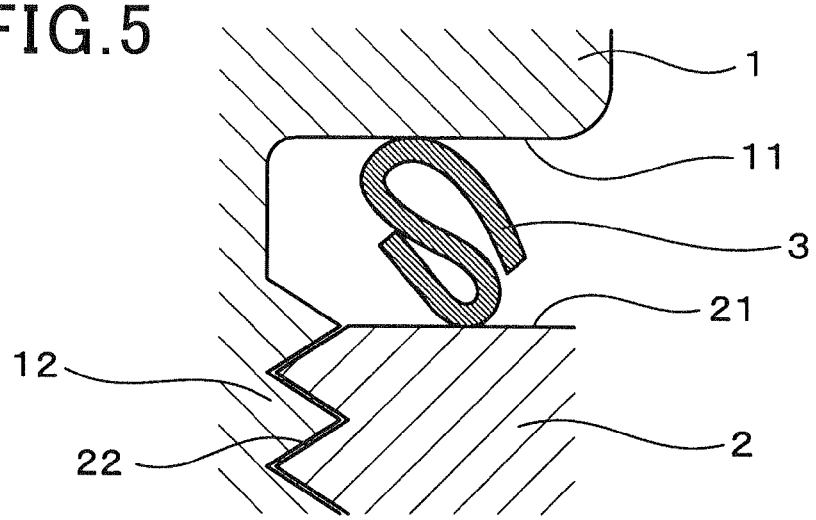
FIG. 5 is an enlarged cross-sectional view illustrating the gasket before being elastically deformed.
Figure 6:
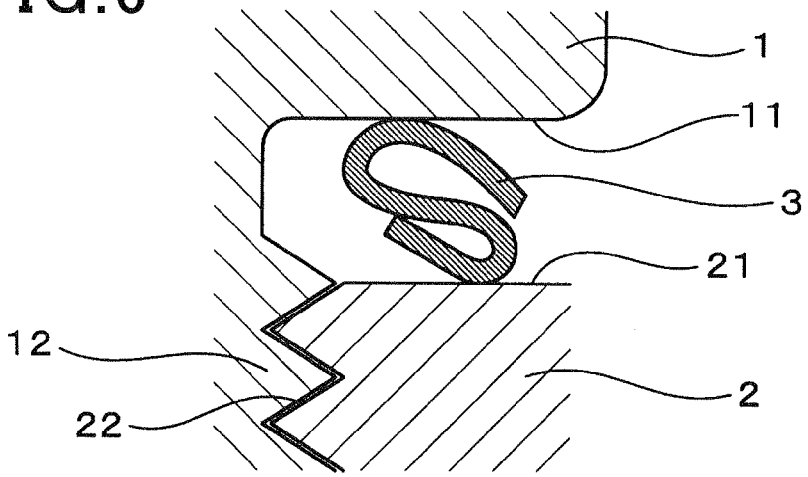
FIG. 6 is an enlarged cross-sectional view illustrating the gasket being elastically deformed during the tightening of a male-threaded portion of the spark plug into a female-threaded portion of the cylinder head.
Figure 7:
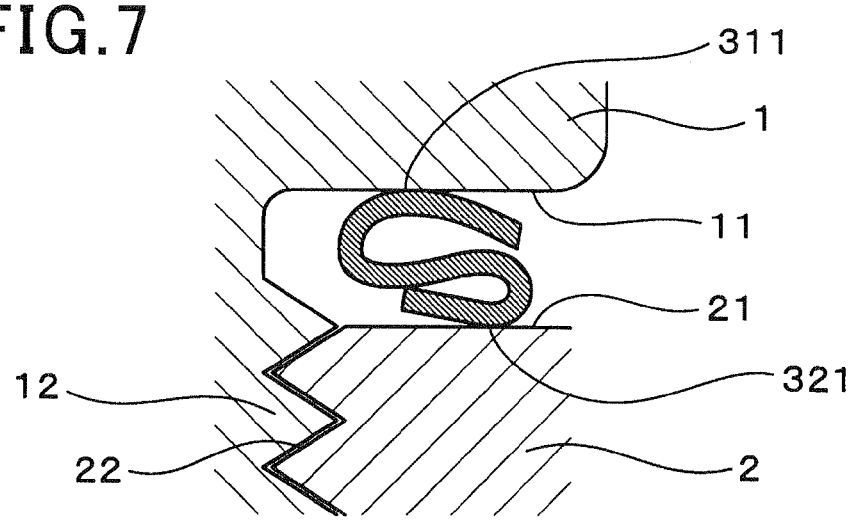
FIG. 7 is an enlarged cross-sectional view illustrating the gasket after completion of the tightening of the male-threaded portion of the spark plug into the female-threaded portion of the cylinder head.

FIG. 5 shows the gasket 3 in a free state, where the gasket 3 is not yet deformed and thus has its original shape. FIG. 6 shows the gasket 3 being elastically deformed during the tightening of the male-threaded portion 12 of the spark plug 1 into the female-threaded portion 22 of the cylinder head 2. FIG. 7 shows the gasket 3 after completion of the tightening of the male-threaded portion 12 of the spark plug 1 into the female-threaded portion 22 of the cylinder head 2.

In mounting the spark plug 1 to the cylinder head 2, the gasket 3 is first disposed so that it surrounds the metal shell 120 of the spark plug 1 and is axially interposed between the seating surface 11 of the spark plug 1 and the seat surface 21 of the cylinder head 2. Then, the male-threaded portion 12 of the spark plug 1 is tightened into the female-threaded portion 22 of the cylinder head 2, thereby retaining the gasket 3 between the seating surface 11 of the spark plug 1 and the seat surface 21 of the cylinder head 2 as shown in FIG. 5. Thereafter, the male-threaded portion 12 of the spark plug 1 is further tightened into the female-threaded portion 22 of the cylinder head 2, elastically deforming the gasket 3 as shown in FIG. 6. More specifically, with the elastic deformation of the gasket 3, the contact region between the seating surface 11 of the spark plug 1 and the gasket 3 is shifted radially inward, while the contact region between the seat surface 21 of the cylinder head 2 and the gasket 3 is shifted radially outward. In other words, with the elastic deformation of the gasket 3, the cross section of the gasket 3 as shown in FIGS. 5-7 is rotated counterclockwise taking the midpoint of a line segment connecting the contact region between the seating surface 11 of the spark plug 1 and the gasket 3 and the contact region between the seat surface 21 of the cylinder head 2 and the gasket 3 as its axis of rotation. Consequently, after the male-threaded portion 12 of the spark plug 1 is completely tightened into the female-threaded portion 22 of the cylinder head 2, the first contact surface 311 of the gasket 3 is offset radially inward from the second contact surface 321 of the gasket 3 as shown in FIG. 7. The first contact surface 311 of the gasket 3 is in pressed contact with the seating surface 11 of the spark plug 1, while the second contact surface 321 of the gasket 3 is in pressed contact with the seat surface 21 of the cylinder head 2. As a result, the gasket 3 makes up a hermetic seal (or fluid-tight seal) for sealing between the seating surface 11 of the spark plug 1 and the seat surface 21 of the cylinder head 2.

In addition, as can be seen from FIGS. 5-7, during the mounting of the spark plug 1 to the cylinder head 2, the overall cross-sectional shape of the gasket 3 is only slightly changed; however, the degree of inclination of the gasket 3 with respect to the axial direction of the spark plug 1 is considerably changed.

The above-described assembly 100 according to the present embodiment has the following advantages.

In the present embodiment, the assembly 100 includes the spark plug 1, the cylinder head 2 (i.e., a part of a main body of the engine), and the substantially annular gasket 3. The cylinder head 2 has the spark plug-mounting bore formed therein. The cylinder head 2 also has the female-threaded portion 22 that is formed in the inner surface of the spark plug-mounting bore and the seat surface 21 that is formed around the second open end (i.e., the open end on the opposite side to the combustion chamber 60) of the spark plug-mounting bore. The spark plug 1 has the male-threaded portion 12 that is formed on the outer surface of the metal shell 120 of the spark plug 1 so as to threadedly engage with the female-threaded portion 22 of the cylinder head 2. The spark plug 1 also has the seating surface 11 that is formed on the proximal side of the male-threaded portion 12 so as to face the seat surface 21 of the cylinder head 2. The gasket 3 is interposed between the seat surface 21 of the cylinder head 2 and the seating surface 11 of the spark plug 1 so as to hermetically seal therebetween. The spark plug 1 is mounted to the cylinder head 2 by tightening the male-threaded portion 12 of the spark plug 1 into the female-threaded portion 22 of the cylinder head 2 with the gasket 3 elastically deformed between the seat surface 21 of the cylinder head 2 and the seating surface 11 of the spark plug 1. The gasket 3 is made of a metallic material whose yield stress or 0.2% proof stress is higher than or equal to 200 N/mm$^2$. The gasket 3 has the first contact surface 311 that is in contact with the seating surface 11 of the spark plug 1 and the second contact surface 321 that is in contact with the seat surface 21 of the cylinder head 2. The first and second contact surfaces 311 and 321 of the gasket 3 are each formed as a part of a curved surface that has a convex shape on a cross section of the gasket 3 as shown in FIG. 2; the cross section is taken so as to lie in the same plane as the longitudinal axis 70 of the spark plug 1. The first and second contact surfaces 311 and 321 of the gasket 3 are offset from each other in the radial direction of the spark plug 1.

With the above configuration, during the mounting of the spark plug 1 to the cylinder head 2, the substantially annular gasket 3 can be elastically deformed, by the tightening axial force of the male-threaded portion 12 of the spark plug 1, over the entire circumference of the gasket 3 in such a manner that the contact region between the seating surface 11 of the spark plug 1 and the gasket 3 is shifted radially inward, while the contact region between the seat surface 21 of the cylinder head 2 and the gasket 3 is shifted radially outward. That is, the gasket 3 can be deformed not locally, but over its entirety. Therefore, even if a large force is applied to the gasket 3, it is difficult for the deformation of the gasket 3 to reach the plastic region (in other words, it is easy for the deformation of the gasket 3 to remain in the elastic region). Consequently, during operation of the engine, even if a large external force is applied to the gasket 3 due to vibration of the engine, it is still possible to prevent the gasket 3 from being plastically deformed, thereby preventing the sealing performance of the gasket 3 from being lowered.

Moreover, since the gasket 3 can be deformed over its entirety, it is unnecessary for the metallic material, of which the gasket 3 is made, to have an extremely high yield stress or 0.2% proof stress for the purpose of preventing plastic deformation of the gasket 3 from occurring under a large force. In other words, it is possible to make the gasket 3 with a metallic material that has a moderate yield stress or 0.2% proof stress. Consequently, during the mounting of the spark plug 1 to the cylinder head 2, it is easy for the gasket 3 to be elastically deformed by the tightening axial force of the male-threaded portion 12 of the spark plug 1, thereby reliably bringing the first and second contact surfaces 311 and 321 of the gasket 3 respectively into intimate contact with the seating surface 11 of the spark plug 1 and the seat surface 21 of the cylinder head 2. As a result, it is possible for the gasket 3 to reliably seal between the seating surface 11 of the spark plug 1 and the seat surface 21 of the cylinder head 2.

Furthermore, since the first and second contact surfaces 311 and 321 of the gasket 3 are each formed as a part of a curved surface that has a convex shape on the cross section of the gasket 3 as shown in FIG. 2, it is possible to realize approximately circular-line contacts between the first contact surface 311 and the seating surface 11 of the spark plug 1 and between the second contact surface 321 and the seat surface 21 of the cylinder head 2, thereby more reliably securing a high sealing performance of the gasket 3.

Furthermore, since the yield stress or 0.2% proof stress of the metallic material, of which the gasket 3 is made, is higher than or equal to 200 $N/mm^2$, it is possible to more reliably prevent plastic deformation of the gasket 3 from occurring under a large force. In addition, if the yield stress or 0.2% proof stress of the metallic material was lower than 200 $N/mm^2$, it would be easy for the gasket 3 to be plastically deformed under a large force, making it difficult to secure a high sealing performance of the gasket 3.

In the present embodiment, the metallic material, of which the gasket 3 is made, is stainless steel. Consequently, it is possible to more reliably achieve the above-described advantageous effects of the gasket 3.

In the present embodiment, the cross section of the gasket 3 as shown in FIG. 2, which is taken so as to lie in the same plane as the longitudinal axis 70 of the spark plug 1, has the substantially S-shape or substantially inverted S-shape. Consequently, it is possible to easily form the above-described first and second contact surfaces 311 and 321 in the gasket 3.

In the present embodiment, the amount of radial offset P between the first and second contact surfaces 311 and 321 is set to be greater than or equal to 0.6 mm.

Setting the amount of radial offset P as above, during the mounting of the spark plug 1 to the cylinder head 2, it is possible to easily realize the elastic deformation of the gasket 3 in the above-described manner (i.e., the contact region between the seating surface 11 of the spark plug 1 and the gasket 3 is shifted radially inward, while the contact region between the seat surface 21 of the cylinder head 2 and the gasket 3 is shifted radially outward). Moreover, even if a large force is applied to the gasket 3, it is possible to prevent the deformation of the gasket 3 from reaching the plastic region, thereby preventing the sealing performance of the gasket 3 from being lowered.

In the present embodiment, the mean value L0 of the radial width L1 of the first contact surface 311 and the radial width L2 of the second contact surface 321 of the gasket 3 is set to be in the range of 0.2 to 0.7 mm.

Setting the mean value L0 as above, it is possible to secure a high sealing performance of the gasket 3. In addition, if the mean value L0 was less than 0.2 mm, the widths of seals formed between the first contact surface 311 and the seating surface 11 of the spark plug 1 and between the second contact surface 321 and the seat surface 21 of the cylinder head 2 would be too small to secure a high sealing performance of the gasket 3. On the other hand, if the mean value L0 was greater than 0.7 mm, the contact pressures between the first contact surface 311 and the seating surface 11 of the spark plug 1 and between the second contact surface 321 and the seat surface 21 of the cylinder head 2 would be too low to secure a high sealing performance of the gasket 3.

Other Embodiments

Figure 8:
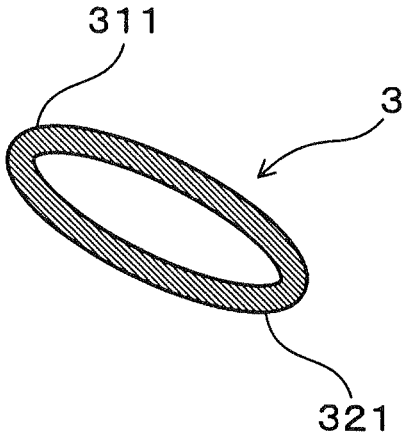
FIG. 8 is an enlarged cross-sectional view of part of a gasket according to a second embodiment.

FIG. 8 shows a cross section of part of a gasket 3 according to a second embodiment; the cross section is taken so as to lie in the same plane as the longitudinal axis 70 (see FIG. 1) of the spark plug 1.

As shown in FIG. 8, in the second embodiment, the cross section of the gasket 3 has an elliptical shape. That is, the gasket 3 is provided in the form of an annular tube that has an elliptical cross section.

Figure 9:
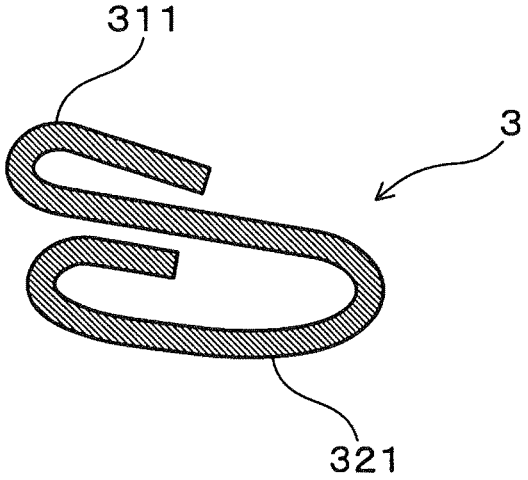
FIG. 9 is an enlarged cross-sectional view of part of a gasket according to a third embodiment.

FIG. 9 shows a cross section of part of a gasket 3 according to a third embodiment; the cross section is taken so as to lie in the same plane as the longitudinal axis 70 of the spark plug 1.

As shown in FIG. 9, in the third embodiment, the cross section of the gasket 3 has three turn portions. The second contact surface 321 of the gasket 3 for making contact with the seat surface 21 of the cylinder head 2 is provided between two of the three turn portions.

Figure 10:
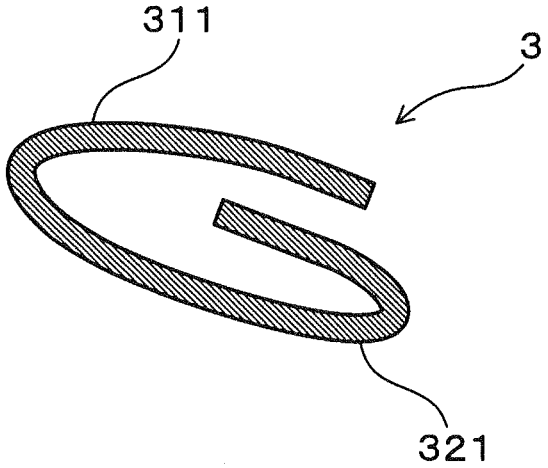
FIG. 10 is an enlarged cross-sectional view of part of a gasket according to a fourth embodiment.

FIG. 10 shows a cross section of part of a gasket 3 according to a fourth embodiment; the cross section is taken so as to lie in the same plane as the longitudinal axis 70 of the spark plug 1.

As shown in FIG. 10, in the fourth embodiment, the cross section of the gasket 3 has two turn portions and two ends. The first contact surface 311 of the gasket 3 for making contact with the seating surface 311 of the spark plug 1 is provided between one of the two turn portions (i.e., the upper-left one in FIG. 10) and one of the two ends (i.e., the upper one in FIG. 10) of the cross section. The second contact surface 321 of the gasket 3 for making contact with the seat surface 21 of the cylinder head 2 is provided between the two turn portions. The one end of the cross section extends, between the first and second contact surfaces 311 and 321, over the other end (i.e., the lower one in FIG. 10) of the cross section toward the other turn portion (i.e., the lower-right one in FIG. 10).

While the above particular embodiments have been shown and described, it will be understood by those skilled in the art that various modifications, changes, and improvements may be made without departing from the spirit of the invention.

For example, in the first embodiment, the first contact surface 311 of the gasket 3 for making contact with the seating surface 311 of the spark plug 1 is arranged radially inward of the second contact surface 321 of the gasket 3 for making contact with the seat surface 21 of the cylinder head 2 (see FIG. 2). However, though not graphical shown, the first contact surface 311 of the gasket 3 may also be arranged radially outward of the second contact surface 321 of the gasket 3.

Experiment

This experiment has been conducted to evaluate the sealing performance of the assembly 100 according to the first embodiment.

Specifically, in the experiment, for each of a plurality of samples of the assembly 100, an airtightness test was conducted according to JISB8031 (i.e., "Internal combustion engines-Spark-plugs", revised on Dec. 20, 2006). In the airtightness test, under given conditions, the spark plug 1 of the sample was first exposed to an atmosphere of 150° C. for 30 minutes. Then, with an air pressure of 1.5 MPa being applied to the igniting portion of the spark plug 1, the leakage rate of air from the inside of the spark plug 1 was measured.

For all the samples of the assembly 100, the size of the metal shell 120 of the spark plug 1 was M14. That is, the minor diameter of the male-threaded portion 12 of the metal shell 120 was 14 mm. Moreover, both the metal shell 120 of the spark plug 1 and the cylinder head 2 were made of aluminum. The gasket 3 was made of SUS304 (a kind of stainless steel specified in JIS), whose 0.2% proof stress is 205 $N/mm^2$.

However, the tightening torque of the male-threaded portion 12 of the spark plug 1 into the female-threaded portion 22 of the cylinder head 2, the plate thickness t of the gasket 3 (see FIG. 2), and the amount of radial offset P between the first and second contact surfaces 311 and 321 of the gasket 3 were varied for the samples of the assembly 100.

More specifically, for each of the samples, the tightening torque was set to one of 17.5 Nm, 20 Nm, 22.5 Nm, 25 Nm, 27.5 Nm, 30 Nm, and 32.5 Nm; the plate thickness t of the gasket 3 was set to one of 0.25 mm, 0.3 mm, and 0.35 mm; the amount of radial offset P was set to one of 0.0 mm, 0.6 mm, and 1.2 mm.

The measurement results of the samples are shown in FIGS. 11-18, in which: the plots "◆" indicate the measurement results of those samples which had the plate thickness t of the gasket 3 equal to 0.25 mm; the plots "○" indicate the measurement results of those samples which had the plate thickness t of the gasket 3 equal to 0.30 mm; and the plots "Δ" indicate the measurement results of those samples which had the plate thickness t of the gasket 3 equal to 0.35 mm.

In addition, it is prescribed in JIS (Japanese Industrial Standards) that: the tightening torque be in the range of 20 to 30 Nm; and the allowable leakage rate of air be lower than or equal to 1 ml/min.

Figure 11:
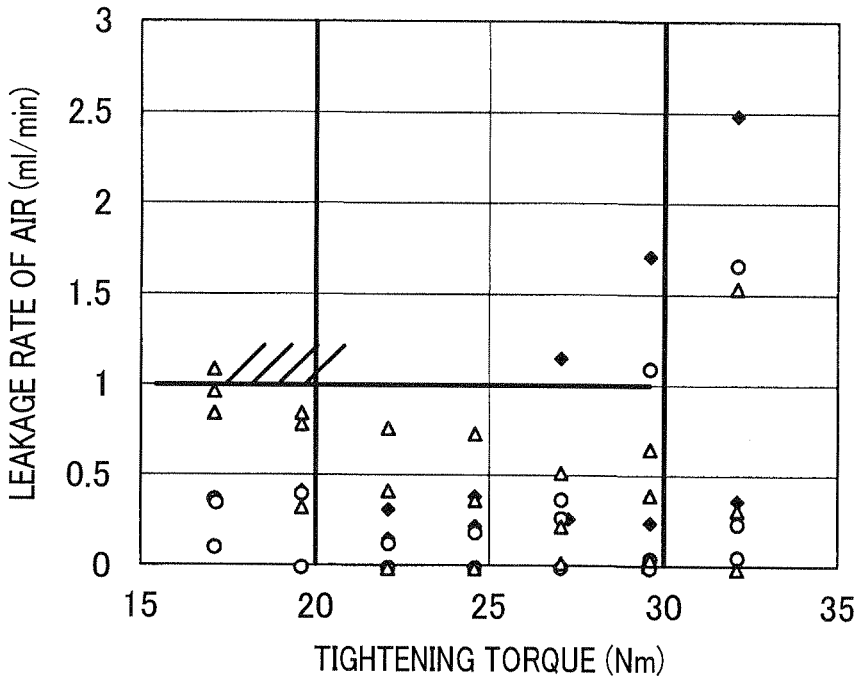
FIG. 11 is a graphical representation illustrating the relationship between the tightening torque of the male-threaded portion of the spark plug into the female-threaded portion of the cylinder head and the leakage rate of air from the inside of the spark plug for all samples of the assembly according to the first embodiment tested in an experiment.

FIG. 11 illustrates the relationship between the tightening torque of the male-threaded portion 12 of the spark plug 1 into the female-threaded portion 22 of the cylinder head 2 and the leakage rate of air from the inside of the spark plug 1 for all the samples.

As seen from FIG. 11, when the tightening torque was too large or too small, the leakage rate of air was so high as to even exceed 1 ml/min. Moreover, even when the tightening torque was in the range of 20 to 30 Nm prescribed in JIS, the leakage rate of air higher than 1 ml/min was observed for some of the samples.

Figure 12:
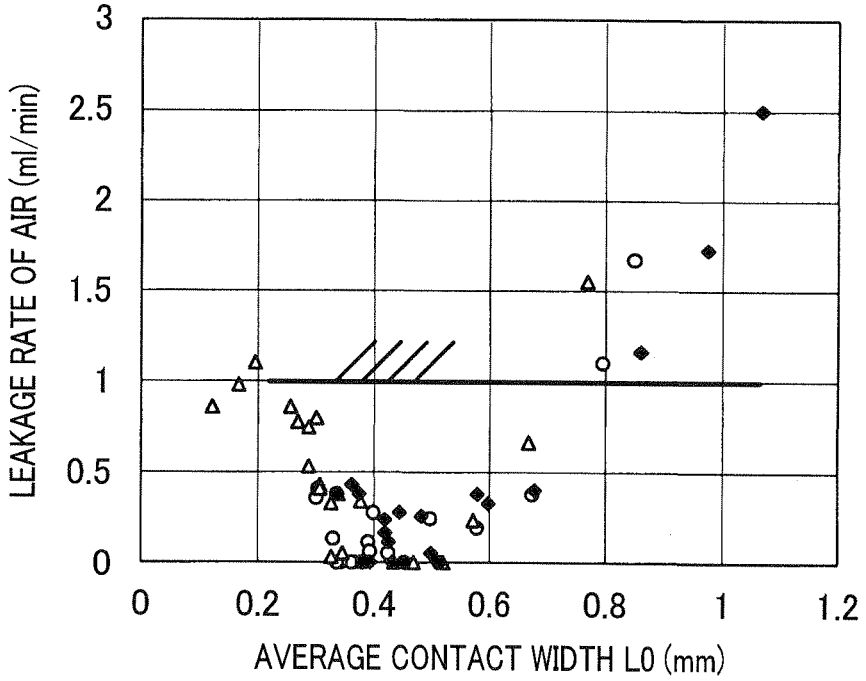
FIG. 12 is a graphical representation illustrating the relationship between an average contact width of the gasket and the leakage rate of air from the inside of the spark plug for all the samples of the assembly.

FIG. 12 illustrates the relationship between the average contact width L0 of the gasket 3 and the leakage rate of air from the inside of the spark plug 1 for all the samples. Here, the average contact width L0 denotes the mean value L0 of the radial width L1 of the first contact surface 311 and the radial width L2 of the second contact surface 321 of the gasket 3 (see FIG. 2).

As seen from FIG. 12, when the average contact width L0 of the gasket 3 was too large or too small, the leakage rate of air was so high as to even exceed 1 ml/min. However, when the average contact width L0 of the gasket 3 was in the range of 0.2 to 0.7 mm, the leakage rate of air was sufficiently low.

Accordingly, it is made clear from FIG. 12 that it is preferable to set the average contact width L0 of the gasket 3 in the range of 0.2 to 0.7 mm so as to secure a high sealing performance of the assembly 100.

Further, all the measurement data shown in FIG. 12 are divided into three sets. The first set consists of the measurement data of those samples which had the amount of radial offset P between the first and second contact surfaces 311 and 321 of the gasket 3 equal to 0.0 mm (i.e., the first and second contact surfaces 311 and 321 are not radially offset from each other). The second set consists of the measurement data of those samples which had the amount of radial offset P equal to 0.6 mm. The third set consists of the measurement data of those samples which had the amount of radial offset P equal to 1.2 mm. The first to third sets of the measurement data are respectively shown in FIGS. 13, 14 and 15.

Figure 13:
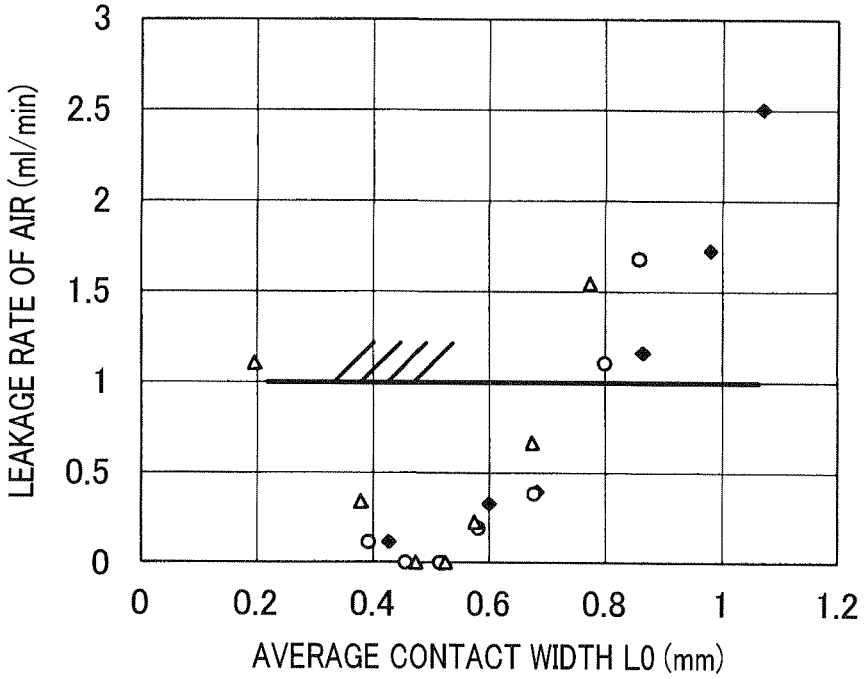
FIG. 13 is a graphical representation illustrating the relationship between the average contact width of the gasket and the leakage rate of air from the inside of the spark plug for those of the samples which had the amount of radial offset between first and second contact surfaces of the gasket equal to 0.0 mm.

As seen from FIG. 13, with the amount of radial offset P equal to 0.0 mm, the leakage rate of air higher than 1 ml/min was observed for some of the samples.

In addition, with the amount of radial offset P equal to 0.0 mm, it is easy for the average contact width L0 of the gasket 3 to become large. Further, as shown in FIG. 13, with increase in the average contact width L0, the leakage rate of air also increased.

Figure 14:
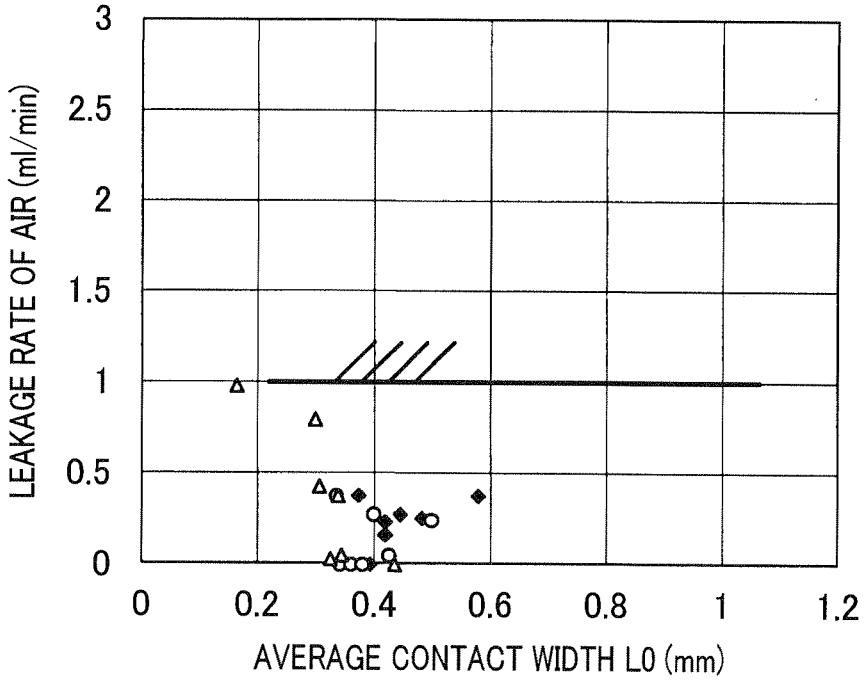
FIG. 14 is a graphical representation illustrating the relationship between the average contact width of the gasket and the leakage rate of air from the inside of the spark plug for those of the samples which had the amount of radial offset between the first and second contact surfaces of the gasket equal to 0.6 mm.
Figure 15:
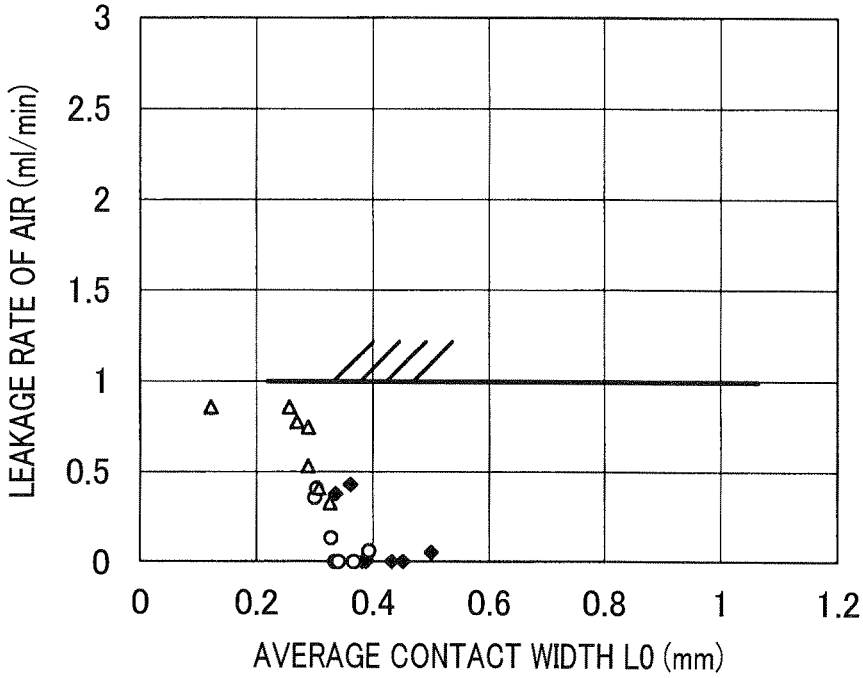
FIG. 15 is a graphical representation illustrating the relationship between the average contact width of the gasket and the leakage rate of air from the inside of the spark plug for those of the samples which had the amount of radial offset between the first and second contact surfaces of the gasket equal to 1.2 mm.

In comparison, as shown in FIGS. 14 and 15, with the amount of radial offset P equal to 0.6 mm or 1.2 mm, the leakage rate of air was lower than 1 ml/min.

Accordingly, it is made clear from FIGS. 13-15 that: the sealing performance of the assembly 100 can be improved by radially offsetting the first and second contact surfaces 311 and 321 of the gasket 3 from each other; and a high sealing performance of the assembly 100 can be secured by setting the amount of radial offset P between the first and second contact surfaces 311 and 321 to be greater than or equal to 0.6 mm.

Furthermore, all the measurement data shown in FIG. 11 are also divided into three sets. The first set consists of the measurement data of those samples which had the amount of radial offset P between the first and second contact surfaces 311 and 321 of the gasket 3 equal to 0.0 mm (i.e., the first and second contact surfaces 311 and 321 are not radially offset from each other). The second set consists of the measurement data of those samples which had the amount of radial offset P equal to 0.6 mm. The third set consists of the measurement data of those samples which had the amount of radial offset P equal to 1.2 mm. The first to third sets of the measurement data are respectively shown in FIGS. 16, 17 and 18.

Figure 16:
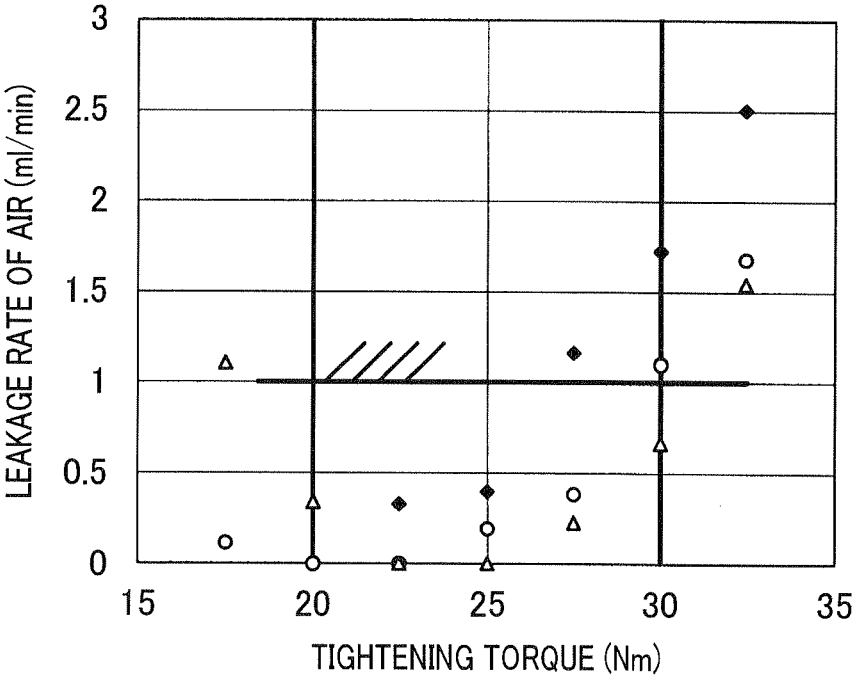
FIG. 16 is a graphical representation illustrating the relationship between the tightening torque of the male-threaded portion of the spark plug into the female-threaded portion of the cylinder head and the leakage rate of air from the inside of the spark plug for those of the samples which had the amount of radial offset between the first and second contact surfaces of the gasket equal to 0.0 mm.

As seen from FIG. 16, with the amount of radial offset P equal to 0.0 mm, the leakage rate of air higher than 1 ml/min was observed for some of the samples even when the tightening torque was in the range of 20 to 30 Nm.

Figure 17:
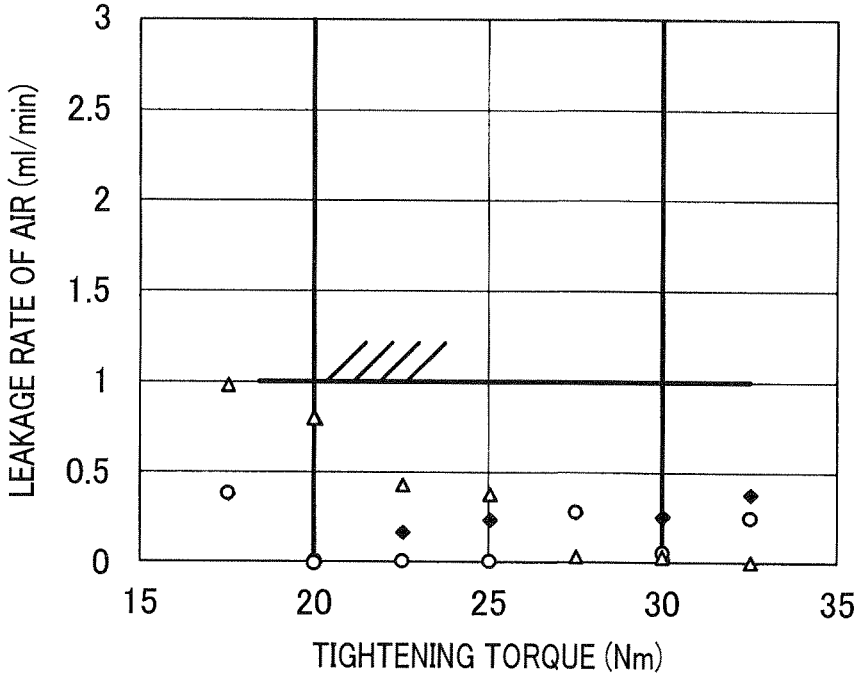
FIG. 17 is a graphical representation illustrating the relationship between the tightening torque of the male-threaded portion of the spark plug into the female-threaded portion of the cylinder head and the leakage rate of air from the inside of the spark plug for those of the samples which had the amount of radial offset between the first and second contact surfaces of the gasket equal to 0.6 mm.
Figure 18:
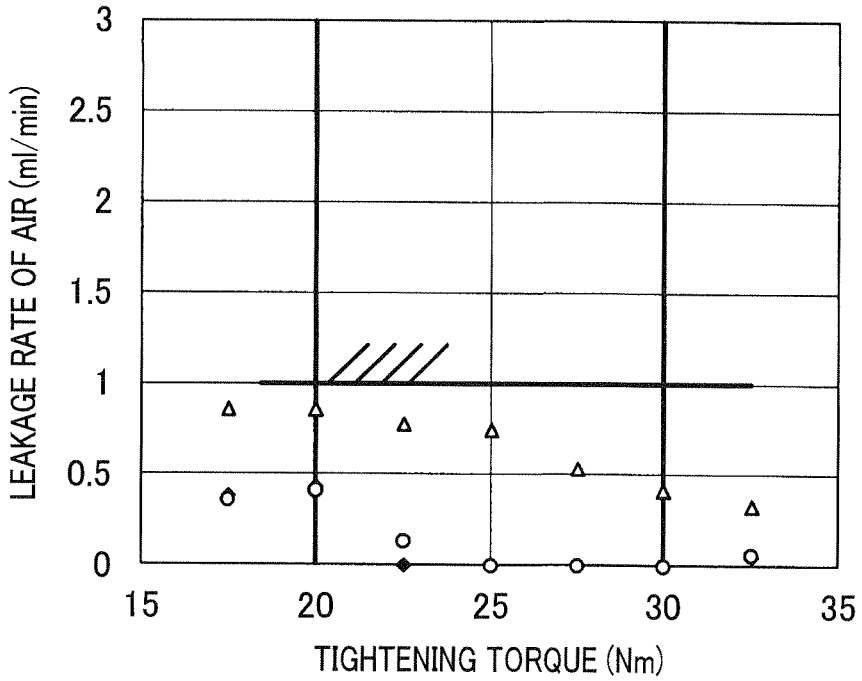
FIG. 18 is a graphical representation illustrating the relationship between the tightening torque of the male-threaded portion of the spark plug into the female-threaded portion of the cylinder head and the leakage rate of air from the inside of the spark plug for those of the samples which had the amount of radial offset between the first and second contact surfaces of the gasket equal to 1.2 mm.

In comparison, as shown in FIGS. 17 and 18, with the amount of radial offset P equal to 0.6 mm or 1.2 mm, the leakage rate of air was lower than 1 ml/min when the tightening torque was in the range of 20 to 30 Nm. In addition, even when the tightening torque was equal to 17.5 or 32.5 mm and thus fell out of the range of 20 to 30 Nm, the leakage rate of air was still lower than 1 ml/min.

Accordingly, it is made clear also from FIGS. 16-18 that: the sealing performance of the assembly 100 can be improved by radially offsetting the first and second contact surfaces 311 and 321 of the gasket 3 from each other; and a high sealing performance of the assembly 100 can be secured by setting the amount of radial offset P between the first and second contact surfaces 311 and 321 to be greater than or equal to 0.6 mm.

What is claimed is:

1. An assembly comprising:

a main body of an engine having a spark plug-mounting bore formed therein, the main body also having a female-threaded portion that is formed in an inner surface of the spark plug-mounting bore and a seat surface that is formed around an open end of the spark plug-mounting bore;

a spark plug having a longitudinal axis and a male-threaded portion that is formed on an outer surface of the spark plug so as to threadedly engage with the female-threaded portion of the main body of the engine, the spark plug also having a seating surface that is formed on one side of the male-threaded portion so as to face the seat surface of the main body of the engine; and a substantially annular gasket interposed between the seat surface of the main body of the engine and the seating surface of the spark plug so as to hermetically seal therebetween, wherein the spark plug is mounted to the main body of the engine by tightening the male-threaded portion of the spark plug into the female-threaded portion of the main body with the gasket elastically deformed between the seat surface of the main body of the engine and the seating surface of the spark plug, the gasket is made of a metallic material whose yield stress or 0.2% proof stress is higher than or equal to 200 $N/mm^2$, the gasket has a first contact surface that is in contact with the seating surface of the spark plug and a second contact surface that is in contact with the seat surface of the main body of the engine, the first and second contact surfaces of the gasket are each formed as a part of a curved surface that has a convex shape on a cross section of the gasket, the cross section being taken so as to lie in the same plane as the longitudinal axis of the spark plug, the first and second contact surfaces of the gasket are offset from each other in a radial direction of the spark plug, and the amount of radial offset between the first and second contact surfaces of the gasket is greater than or equal to 0.6 mm.

2. The assembly as set forth in claim 1, wherein the metallic material, of which the gasket is made, is stainless steel.

3. The assembly as set forth in claim 2, wherein the cross section of the gasket, which is taken so as to lie in the same plane as the longitudinal axis of the spark plug, has a substantially S-shape or substantially inverted S-shape.

4. The assembly as set forth in claim 3, wherein the mean value of a radial width L1 of the first contact surface and a radial width L2 of the second contact surface of the gasket is in the range of 0.2 to 0.7 mm.

5. The assembly as set forth in claim 1, wherein the cross section of the gasket, which is taken so as to lie in the same plane as the longitudinal axis of the spark plug, has a substantially S-shape or substantially inverted S-shape.

6. The assembly as set forth in claim 1, wherein the mean value of a radial width L1 of the first contact surface and a radial width L2 of the second contact surface of the gasket is in the range of 0.2 to 0.7 mm.

* * * * *